US005284617A

United States Patent [19]

Tiwari et al.

[11] Patent Number: 5,284,617

[45] Date of Patent: Feb. 8, 1994

[54] PROCESS FOR DEALUMINIZING MOLTEN CAST IRON

[75] Inventors: Basant L. Tiwari, Sterling Heights; Seymour Katz, West Bloomfield, both of Mich.

[73] Assignee: General Motors Corporation, Detroit, Mich.

[21] Appl. No.: 941,288

[22] Filed: Sep. 4, 1992

[51] Int. Cl.[5] ..... C22C 33/00

[52] U.S. Cl. ..... 420/33; 75/310; 75/560; 75/565; 75/570

[58] Field of Search ..... 420/33; 75/560, 565, 75/570, 310

[56] References Cited

U.S. PATENT DOCUMENTS

| | | | |
|---|---|---|---|
| 2,306,976 | 12/1942 | Pedersen | 75/53 |
| 2,694,023 | 11/1954 | Hopkins | 148/26 |
| 3,320,052 | 5/1967 | Bowden | 75/53 |
| 3,446,614 | 5/1969 | Johnson | 420/33 |
| 3,617,259 | 11/1971 | Doliwa | 420/33 |
| 3,998,624 | 12/1976 | Harris et al. | 75/30 |
| 4,040,818 | 8/1977 | Clegg | 420/21 |
| 5,078,784 | 1/1992 | Craig | 75/310 |

*Primary Examiner*—Peter D. Rosenberg
*Attorney, Agent, or Firm*—Lawrence B. Plant

[57] ABSTRACT

Dealuminizing cast iron by contacting it with free-flowing flux particles having a solid silica core and a molten silica shell wherein said flux comprises silica and about 1% to about 5% calcium fluoride.

6 Claims, 1 Drawing Sheet

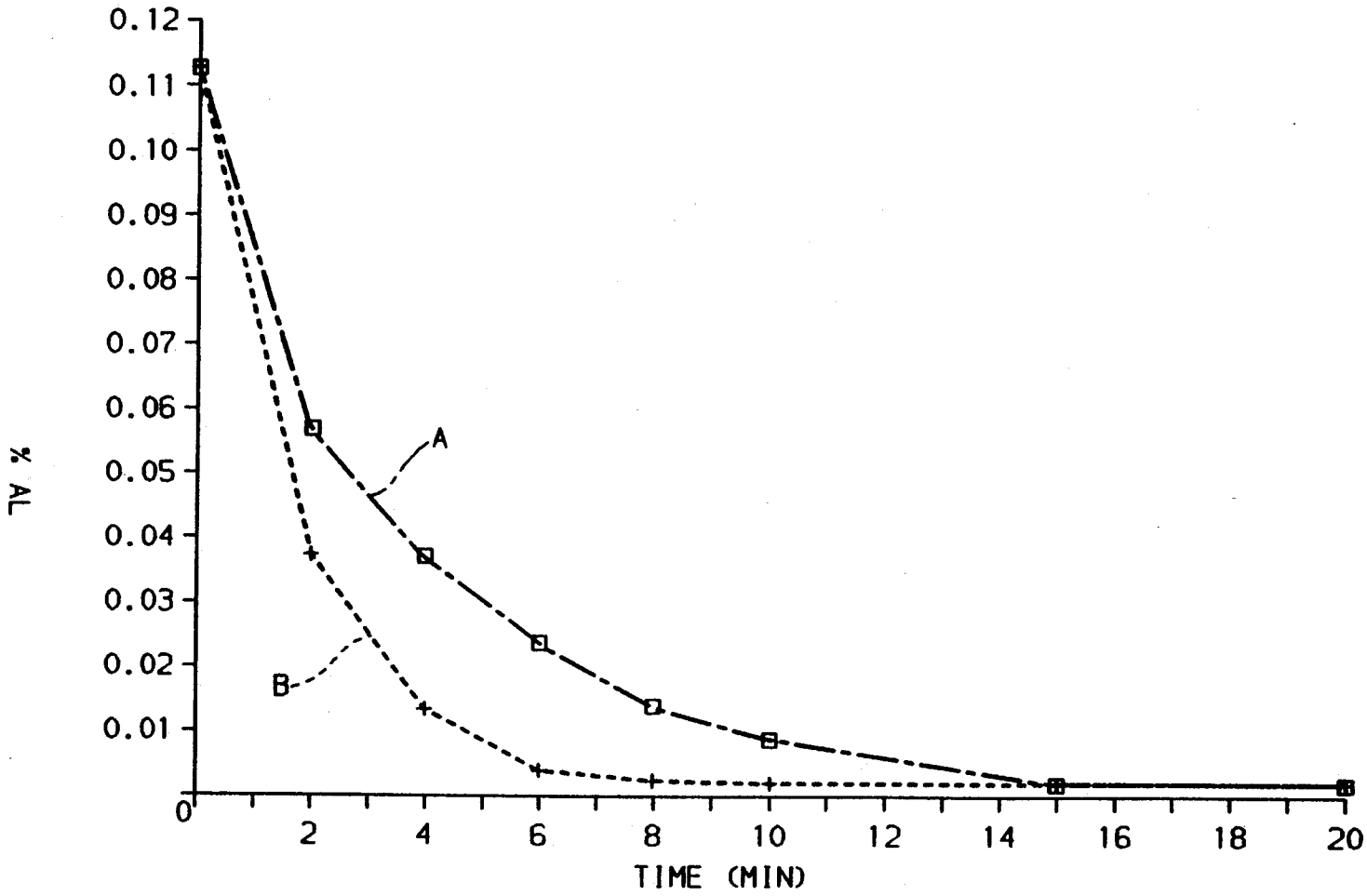
0.12
0.11
0.10
0.09
0.08
0.07
0.06
0.05
0.04
0.03
0.02
0.01
% AL
0
2
4
6
8
10
12
14
16
18
20
TIME (MIN)
A
B

PROCESS FOR DEALUMINIZING MOLTEN CAST IRON

This invention relates to an improved process for removing aluminum from molten cast iron, and more particularly to the use of solid particles carrying a molten $SiO_2$-based flux throughout the molten iron for consuming the metallic contaminants therein while enriching the cast iron with silicon.

BACKGROUND OF THE INVENTION

Automobile scrap is used in many foundries as a source of iron for cast iron. With the increasing use of aluminum in automobiles, the aluminum level in the automobile scrap is significantly higher than in years past. Moreover, it has been found that the addition of aluminum to a coupla charge may reduce coke consumption and silicon loss as well as increase the melt temperature and reduce the sulfur content of the molten cast iron produced therefrom. This iron contains higher then normal deleterious amounts of aluminum. Regardless of the source of aluminum, the aluminum level in molten cast iron may easily reach a level where harmful effects are experienced. For example, the literature indicates that aluminum concentrations greater than 0.01% by weight may cause pinholes in the castings. In addition to the pinholes, the presence of aluminum causes excess dross formation due to continuous oxidation of aluminum to aluminum oxide which all too often becomes entrapped in the melt which, in turn, introduces inclusions in the castings. Moreover, excess dross formation creates metal handling problems and increases the metal loss.

Heretofore, attempts have been made to oxidize the aluminum by bubbling air and/or oxygen through the melt or by using a high velocity lance positioned above the melt surface and projecting the oxygen/air onto the surface. Moreover, solid reagents such as iron ore, ferric oxide, sodium sulfate, or manganese oxide have also been used to oxidize the aluminum. Unfortunately, such oxidizing agents also react with any carbon and silicon present in the melt and thereby reduce their concentrations. The sodium sulfate additionally contaminates the melt with sulfur and produces sodium vapor. Chlorine and molten manganese chloride flux have also been reported as candidates for removing aluminum without affecting the silicon and carbon content of the melt. Chlorine unfortunately produces a considerable amount of iron chloride fume which causes a pollution problem. Dolomitic limestone additions have also been proposed, but this results in oxidation of carbon, absorption of heat from the melt incident to the decomposition of the carbonates, and formation of considerable MgO and CaO dust aggravated by the formation of $CO_2$ gas. Manganese metal containing some nitrogen has been proposed, but is ineffective in reducing aluminum content below 0.01%. Finally, our copending U.S. patent application U.S. Ser. No. 941,287 filed Sep. 4, 1992, and now U.S. Pat. No. 5,240,673, filed concurrently herewith and assigned to the assignee of the present application, describes a process wherein the metallic contaminants react with droplets of molten $SiO_2$—$CaF_2$. In that technique, bubbling nitrogen aggressively through the iron is used to break the molten $SiO_2$—$CaF_2$ pool into small droplets and mix them into the iron for reaction with the undesirable metallics (e.g., aluminum).

The present invention significantly improves our earlier process by providing solid particles having the liquid flux on the surface thereof which significantly accelerates dealuminization while significantly suppressing splashing or expelling of molten metal from the reactor.

It is an object of the present invention to provide an improved process for dealuminizing molten cast iron and removing any other metallic contaminants susceptible to silica oxidation which process utilizes a molten $SiO_2$-based flux disposed on the surface of substantially free-flowing particles of solid $SiO_2$ which carry the flux into the molten iron for highly effective reaction with the aluminum et al therein. This and other objects and advantages of the present invention will become more readily apparent from the detailed description thereof which follows.

The present invention contemplates an improved process for removing aluminum from molten cast iron, which process is simple, pollution-free, quick, does not deplete the molten cast iron of its carbon, enriches the iron with silicon, suppresses iron expulsion from the reactor, and provides highly reactive particles of controlled size which are significantly smaller and hence more reactive than the droplets which were characteristic of our earlier work, U.S. Pat. No. 5,240,673. In this regard, relatively large particles of $SiO_2$ are coated with molten $SiO_2$—$CaF_2$ such that the particles do not become agglomerated and serve as carriers for carrying the molten flux into the iron melt.

While the present invention is most particularly applicable to the removal of aluminum, other silica-oxidizable metals (e.g., certain Periodic Table Group IIIA, IVA and VA metals such as cerium) are also removed by the process of this invention. The present invention contemplates a method for substantially dealuminizing aluminum-containing cast iron, wherein: the iron is heated to a temperature sufficient to keep it molten throughout the period of treatment; a mass of solid, free-flowing flux particles comprising $SiO_2$ and about 1% to about 5% by weight calcium fluoride is disposed atop the molten iron and heated by the underlying melt to melt a small portion of the flux. Once heated, the particles remain free-flowing and each comprise a core of solid silica having a molten silica shell clinging thereto and encapsulating the core. The molten shell comprises at least about 35% by weight calcium fluoride. The molten iron and flux are stirred together in such a manner as to cause the liquid-coated particles to react with the aluminum (i.e., to form aluminum oxide) and release silicon into the melt. The dealuminizing reaction is as follows:

$$3\ SiO_2 + 4\ Al \rightarrow 2\ Al_2O_3 + 3\ Si$$

A side reaction between the silica and calcium fluoride yields a small amount of calcia and silicon tetrafluoride.

In a preferred embodiment, an excess amount of the particles are floated atop the iron melt and act as a blanket for suppressing expulsion of metal from the reactor incident to the vigorous stirring thereof. In this regard, stirring is such as to cause the lower portion of the particle blanket to mix intimately with the iron while the upper portion serves to provide fresh particles to the lower circulating portion as well as to suppress the molten metal being expelled from the reactor due to the mixing for better reaction therewith. The particles preferably have a mean diameter of about 0.25 to about 2 millimeters. Smaller particles have a higher tendency to agglomerate, while larger particles are more difficult to disperse in the molten iron. Most preferably, the particles will have a mean diameter of about 1 millimeter as this size is most readily stirred into the molten iron. The molten shell around the solid core wets and adheres to these relatively large $SiO_2$ particles sufficiently that it does not coalesce with the shells on adjacent particles. Hence, the molten flux wetted particles act essentially as solid particles, remain essentially free-flowing and serve to control the size of the molten silica reactant contacting the melt. In this regard, maintaining a solid core of silica wetted with a molten shell thereover produces a reactive surface area which is much higher than heretofore found possible by dropletizing a pool of molten silica by aggressively bubbling $N_2$ through the metal. The higher surface area provided by the liquid coated solid core accelerates and simplifies the aluminum removal process.

The molten shell comprises a relatively small portion of the particle and depends on the $CaF_2$ content and the temperature of the flux. Hence for example, at 5% by weight $CaF_2$ and 1550° C. the liquid content will be about 15.2% by weight whereas at 2.5% CaF and 1450° C. the liquid content will be about 5.9% by weight and the balance being the solid core particles. The aluminum oxide formed by the dealuminization reaction dissolves in the molten $SiO_2$—$CaF_2$ flux shell. Treatment continues for a sufficient time for the aluminum content thereof to drop to an acceptable level which is preferably below about 0.01% by weight.

The flux generally consists essentially of silicon dioxide and about 1% to about 5% by weight $CaF_2$, and preferably about 2.5% by weight $CaF_2$ and the balance $SiO_2$. Above about 5% $CaF_2$ the flux loses its free-flowing, powdery character and becomes viscous and "gloppy" as the particles begin to agglomerate. Below about 1% by weight $CaF_2$ there is insufficient molten $SiO_2$ formed to be effective.

The flux is floated as a blanket of free-flowing particles atop the iron. The iron is vigorously stirred so as to cause the lower portion of the blanket contiguous the iron to intimately mix with the iron and react with the contaminants (e.g., aluminum) therein. The upper portion of the blanket does not directly mix and react with the iron, but rather serves to suppress splashing of the iron from the reactor and provide fresh make-up particles for the lower portion. The molten iron is preferably stirred by bubbling nitrogen up from the bottom thereof through porous ceramic plugs which are placed in the floor of the reaction vessel. Other known stirring techniques capable of mixing the silica particles into the molten iron are also acceptable.

SPECIFIC EXAMPLES

In one test, a liquid flux comprising 35% $CaF_2$ and 65% $SiO_2$ was used with an iron melt in accordance with our earlier work. The melt contained about 0.113% Al and was analyzed periodically for aluminum over a 15 minute treatment period. The same melt was then mixed with flux coated particles (i.e., 2.5% $CaF_2$-97.5% $SiO_2$) in accordance with the present invention and similarly analyzed over the same period. Curve A of the Figure shows the aluminum concentration in the melt as a function of time for iron treated with droplets of molten flux comprising 65% $SiO_2$ and 35% $CaF_2$. Curve B shows the aluminum concentration as a function of time for iron treated with molten flux ($CaF_2$ 2.5%) carried on a solid SiO particle carrier in accordance with the present invention. The curves show that the desired level of 0.01% aluminum is achieved in about half the time with the process of the present invention as compared to our earlier work.

In another test 2066 lbs. of molten iron (i.e., at 1450° C.) containing 0.05% aluminum was added to a conventional teapot-type reactor. The reactor had an internal diameter of twenty (20) inches, and an internal height thirty-four (34) inches. The height of the iron in the reactor was twenty-six (26) inches. A six (6) inch thick blanket of powdered flux comprising essentially 97.5% $SiO_2$ and 2.5% $CaF_2$ was floated on top of the molten iron. Aluminum contaminated iron was poured into the open mouth of the teapot and passed readily down through the center of the flux particles at a rate of twelve tons per hour, while dealuminized iron exited the spout of the teapot at the same rate. Hence, the average residence time in the reactor was about 5 minutes. Fresh flux was added to the reactor at the rate of 0.12 tons per hour while excess flux overflowed the reactor through a notch in the upper side thereof adjacent the mouth of the reactor. Nitrogen was bubbled upwardly through the reactor at a rate of 150 standard cubic ft./min. This process continued for 140 minutes during which time the average aluminum content was reduced to 0.003% by weight. This was about twice the aluminum removal rate experienced with the same melt using the dropletized molten flux in accordance with our earlier work.

While the invention has been disclosed primarily in terms of specific embodiments thereof it is not intended to be limited thereto, but rather only to the extent set forth hereafter in the claims which follow.

The embodiments of the invention in which an exclusive property or privilege is claimed are defined as follows:

1. A method for substantially dealuminizing cast iron containing a deleterious amount of aluminum, comprising the steps of heating the cast iron to a temperature sufficient to melt said iron, disposing a mass of free-flowing flux particles atop said iron, heating said mass such that each of said particles comprises a core of solid silica and a molten shell encapsulating said core, said flux comprising silica and about 1% to about 5% by weight calcium fluoride, and stirring said iron and said flux so as to cause said particles to intimately mix with said iron such that said molten shell reacts with said aluminum so as to form an oxide thereof and to release silicon into the iron, dissolving the aluminum oxide in said shell, and continuing the foregoing process for a sufficient time to reduce the aluminum content of said iron to below said deleterious amount.

2. A method according to claim 1 wherein said deleterious amount is about 0.01% by weight.

3. A method according to claim 1 wherein said stirring is accomplished by bubbling nitrogen gas upwardly through said molten iron.

4. A method according to claim 1 wherein said mass is provided in a sufficient amount to suppress expulsion of molten iron from the reaction vessel incident to said bubbling.

5. A method according to claim 1 wherein said flux has a mean particle size of about 0.25 to about 2 millimeters.

6. A method according to claim 5 wherein said mean particle size is about 1 millimeter and said shell comprises about 5.9% by weight to about 15.2% by weight of said particle.

* * * * *